US005368100A

United States Patent [19]

Lewandowski et al.

[11] Patent Number: 5,368,100

[45] Date of Patent: Nov. 29, 1994

[54] COILED TUBING ACTUATED SAMPLER

[75] Inventors: David Lewandowski, Fort Worth; Roger L. Schultz, Richardson, both of Tex.

[73] Assignee: Halliburton Company, Houston, Tex.

[21] Appl. No.: 28,680

[22] Filed: Mar. 10, 1993

[51] Int. Cl.[5] ..... F21B 49/08

[52] U.S. Cl. ..... 166/264; 166/169

[58] Field of Search ..... 166/264, 162, 166, 169

[56] References Cited

U.S. PATENT DOCUMENTS

| | | | |
|---|---|---|---|
| 3,606,927 | 9/1971 | True et al. | 166/315 |
| 3,675,718 | 7/1972 | Kanady | 166/297 |
| 4,721,157 | 1/1988 | Berzin | 166/264 X |
| 4,766,955 | 8/1988 | Petermann | 166/264 X |
| 4,787,447 | 11/1988 | Christensen | 166/169 |
| 4,862,958 | 9/1989 | Pringle | 166/72 |
| 4,877,089 | 10/1989 | Burns | 166/377 |
| 4,883,123 | 11/1989 | Zunkel et al. | 166/264 |
| 5,058,674 | 10/1991 | Schultz et al. | 166/264 |
| 5,090,481 | 2/1992 | Pleasants et al. | 166/373 |
| 5,101,904 | 4/1992 | Gilbert | 166/264 X |
| 5,240,072 | 8/1993 | Schultz et al. | 166/264 X |

*Primary Examiner*—William P. Neuder

*Attorney, Agent, or Firm*—Tracy W. Druce; Lucian Wayne Beavers

[57] ABSTRACT

A coiled tubing conveyed sampling apparatus includes an actuator housing having a housing interior and having a proximal housing end including a connector for connecting the housing to a coiled tubing string so that a tubing bore of the coiled tubing string is communicated with the housing interior. A one-way check valve is disposed in the housing interior and allows well fluid from the well bore to fill the tubing bore of the coiled tubing string as the sampling apparatus is run into the well. The check valve isolates the tubing bore of the coiled tubing string from the well when pressure in the tubing bore exceeds pressure in the well. A sampling tool is attached to a lower end of the actuator housing. A pressure responsive actuator is disposed in the housing interior and actuates the sampling tool in response to pressure in the tubing bore of the coiled tubing string exceeding pressure in the well by a first predetermined value so that a well fluid sample is drawn into the sampling tool and trapped in the sampling tool. The apparatus is especially useful in taking samples from horizontal portions of highly deviated wells.

27 Claims, 15 Drawing Sheets

COILED TUBING ACTUATED SAMPLER

BACKGROUND OF THE INVENTION

1. Field Of The Invention

The present invention is related generally to methods and apparatus for sampling using coiled tubing, and more particularly, but not by way of limitation, to such methods and apparatus particularly adapted for use in horizontal wells.

2. Description Of The Prior Art

It is becoming a common practice to drill highly deviated wells often referred to as horizontal wells. Such a highly deviated or horizontal well typically includes a substantially vertical portion followed by a radiused portion which leads to a substantially horizontal portion of the well bore which runs for substantial distances horizontally through a subsurface formation from which oil or gas is to be produced.

Many testing tools which are designed for use on wireline cannot function satisfactorily in horizontal wells because the fact that the wireline tools which depend on gravity for their motive force cannot extend outward into a horizontal portion of the well.

SUMMARY OF THE INVENTION

The present invention provides a sampler constructed to be run on coiled tubing. The sampler is constructed to be actuated in response to an increase in pressure within the coiled tubing and thus provides positive surface control of actuation of the sampler. The sampler is especially useful in horizontal wells since, unlike wireline conveyed samplers, the coiled tubing can be used to move the sampler into the horizontal portion of the well.

The sampling apparatus includes an actuator housing having a housing interior and having a proximal housing end including a connector for connecting the housing to the coiled tubing string so that the tubing bore of the coiled tubing string is communicated with the housing interior.

A check valve is disposed in the housing interior for allowing well fluid from the well to fill the tubing bore of the coiled tubing string as the sampling apparatus is run into the well on the coiled tubing string. The check valve also serves to isolate the tubing bore from the well when pressure in the tubing bore exceeds pressure in the well bore.

A sampling tool is attached to the actuator housing. A pressure responsive actuator means is disposed in the interior of the actuator housing for actuating the sampling tool in response to pressure in the tubing bore exceeding pressure in the well bore by a first value so that a fluid sample is trapped in the sampling tool.

Preferably, a relief and drain valve is also provided for relieving pressure from the tubing bore to the well bore when pressure in the tubing bore exceeds pressure in the well bore by a second value greater than said first value. The relief and drain valve also allows fluid to drain from the tubing bore when the coiled tubing string and sampling apparatus are subsequently retrieved from the well bore.

Methods of taking well fluid samples using such an apparatus include steps of:

(a) running a sampling tool into the well on a coiled tubing string;

(b) during step (a), filling the coiled tubing string with well fluid through a fill port communicating a tubing bore of the coiled tubing string with the well;

(c) increasing tubing pressure in the coiled tubing string and in response to said increasing pressure:
  (1) closing said fill port;
  (2) actuating said sampling tool to trap a well fluid sample therein; and
  (3) opening a drain port communicating the tubing bore with the well;

(d) retrieving said coiled tubing string and sampling tool from the well; and (e) during step (d), draining said tubing bore through said drain port.

Numerous objects, features and advantages of the present invention will be readily apparent to those skilled in the art upon a review of the following disclosure when taken in conjunction with the accompanying drawings.

BRIEF DESCRIPTION OF THE DRAWINGS

FIGS. 2A–2L comprise an elevation partly sectioned view of the sampling apparatus of the present invention in an initial position as it would be run into the well. The one-way check valve is shown in an open position so that well fluid is filling the tubing string on which the sampling apparatus is being run into the well.

DETAILED DESCRIPTION OF THE PREFERRED EMBODIMENTS

Figure 1:
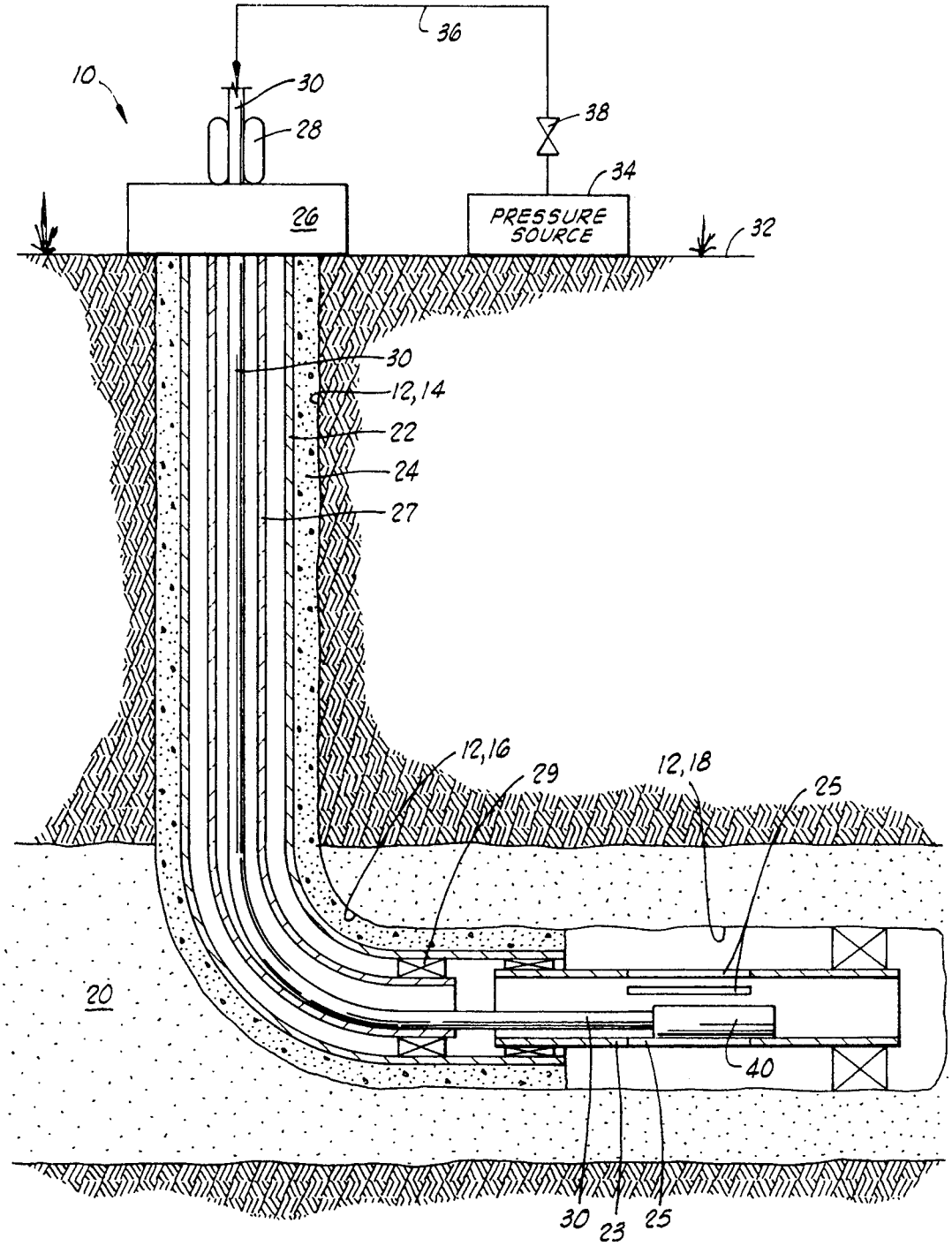
FIG. 1 is a schematic elevation view of a highly deviated well including a vertical portion and a horizontal portion. A coiled tubing string carrying the sampling apparatus of the present invention is shown in place with the sampling apparatus located in the horizontal portion of the well.

Referring now to FIG. 1, a typical highly deviated well is thereshown and generally designated by the numeral 10. The well 10 is constructed by drilling a bore hole 12 having a substantially vertical portion 14, a radiused portion 16, and a generally horizontal or substantially horizontal bore hole portion 18. It will be understood that the generally horizontal portion 18 need not be exactly horizontal. It does, however, have such a shallow slope that conventional wireline conveyed tools cannot be run into the horizontal portion of the well.

The well bore 14, and particularly the horizontal portion 18 thereof is shown as intersecting a subsurface formation 20 from which oil or gas is to be produced.

The well 10 is shown as having casing 22 cemented in the vertical portion and part of the horizontal portion thereof cement 24. The distal part of the horizontal portion 18 thereof remains uncased. A length of slotted liner 23 extends from the distal end of casing 22 into the uncased portion of the hole. Liner 23 has slots 25 which communicate with the open bore hole and thus with formation 20. Production tubing or drill pipe 27 may be placed in the casing 22, and is sealed near the distal end thereof by packer 29.

The upper end of the well is closed by a conventional well head assembly schematically illustrated at 26. Coiled tubing injectors 28 are used to pass a coiled tubing string 30 from a conventional coiled tubing reel (not shown) down through the well head 26 into the well 10.

Located on the earth's surface 32 at a location adjacent the well head 26 is a source of fluid under pressure 34 which is communicated with the coiled tubing string 30 through a pressure supply line 36 having a control valve 38 disposed therein. It will be understood that the pressure supply conduit 36 will be connected to the coiled tubing reel (not shown) in a conventional manner so as to supply fluid pressure to a tubing bore of the coiled tubing string 30.

A sampler apparatus 40 is schematically illustrated in FIG. 1 as being carried on the lower end of coiled tubing string 30 into the horizontal portion 18 of bore hole 12. It will be understood that other tools could be run on the tubing string 30 in addition to the sampler 40, and additionally that centralizers or packers could be run therewith to position the sampler 40 within the bore hole as desired.

It will be understood that many other types of horizontal well completions could be used. For example, the horizontal portion of the well could be an open hole with no casing or liner.

Additionally, many aspects of the present invention are equally suitable to use in the vertical portion of a well. Certain aspects of the invention, however, are particularly useful in taking a sample of fluids being produced into a horizontal portion of a well as illustrated in FIG. 1.

Particularly, the use of the coiled tubing string 30 to run the sampler apparatus 40 into the horizontal portion of the well provides accurate and easy placement of the sampler apparatus 40 at any desired location along the horizontal portion 18 of the bore hole 12. This cannot be accomplished with wireline conveyed tools which depend on gravity as a motive force and which cannot be moved by the wireline any substantial distance into the horizontal portion of the well.

The Sampler Apparatus

FIGS. 2A–2L comprise an elevation partly sectioned view of the sampler apparatus 40 in its initial or run-in position as it would be in when being run down into the well 10. As is further described below, as the apparatus 40 is run down into the well 10, well fluid is allowed to flow into the coiled tubing string 30 to fill the coiled tubing string 30.

The sampler apparatus 40 includes a housing assembly generally designated by the numeral 42. The housing assembly 42 is made up of a number of tubular sections threadedly connected together with appropriate seals therebetween.

The housing assembly 42 includes from top to bottom an upper actuator housing section 44, a lower actuator housing section 46, a first actuator rod housing section 48, a first dump chamber housing section 50, a first blocking valve housing section 52, a first orifice housing section 54, a first oil housing section 56, a first sample valve housing section 58, a first sample chamber housing section 60, a second actuating rod housing section 62, a second dump chamber housing section 64, a second blocking valve housing section 66, a second orifice housing section 68, a second oil housing section 70, a second sample valve housing section 72, a second sample chamber housing section 74, a housing coupling 76 and a housing lower end cap 78.

A bore 79 of the upper actuator housing section 44 defines an interior central housing passage 80 in upper actuator housing section 44. Passage 80 may also be referred to as interior 80 or as an actuating chamber 80. Upper actuator housing section 44 has an open proximal end 82 having internal threads 84 defined therein for connection of the housing assembly 42 to the coiled tubing string 30 in a conventional manner. The threads 84 may be referred to as a connector means 84 for connecting the sampler apparatus 40 to the coiled tubing string 30. When the coiled tubing string 30 is connected to the proximal end 82 of upper actuator housing section 44, the tubing bore of coiled tubing string 30 will be in communication with the interior passage 80 of upper actuator housing section 44.

As used herein, the terms proximal and distal are used to refer to relative portions of the apparatus 40 as viewed from the surface of the well 10. Thus, the end 82 of housing assembly 42 which is closest to the upper end of the well 10 is referred to as the upper or proximal end, and the other end defined by housing lower end cap 78 is referred to as the lower or distal end of the housing assembly 42. The terms proximal and distal are often used herein particularly when describing movements within the horizontal portion 18 of the well since such movements are not truly up and down in a gravitational sense although they may be considered as upward and downward movements in relation to the bore hole 12.

The upper actuator housing section 44 has a plurality of relief and drain ports 86 defined radially therethrough to communicate a housing exterior 88 with the housing interior passage 80.

The upper actuator housing section 44 also includes a plurality of run-in fill ports or passages 90 defined therethrough which also communicate the housing exterior 88 with the interior housing passage 80 of actuator housing section 44.

A relief valve sleeve 92 and an actuator sleeve 94 are threadedly connected together at 95 and are slidably received within the bore 79 of upper actuator housing section 44.

Figure 2A:
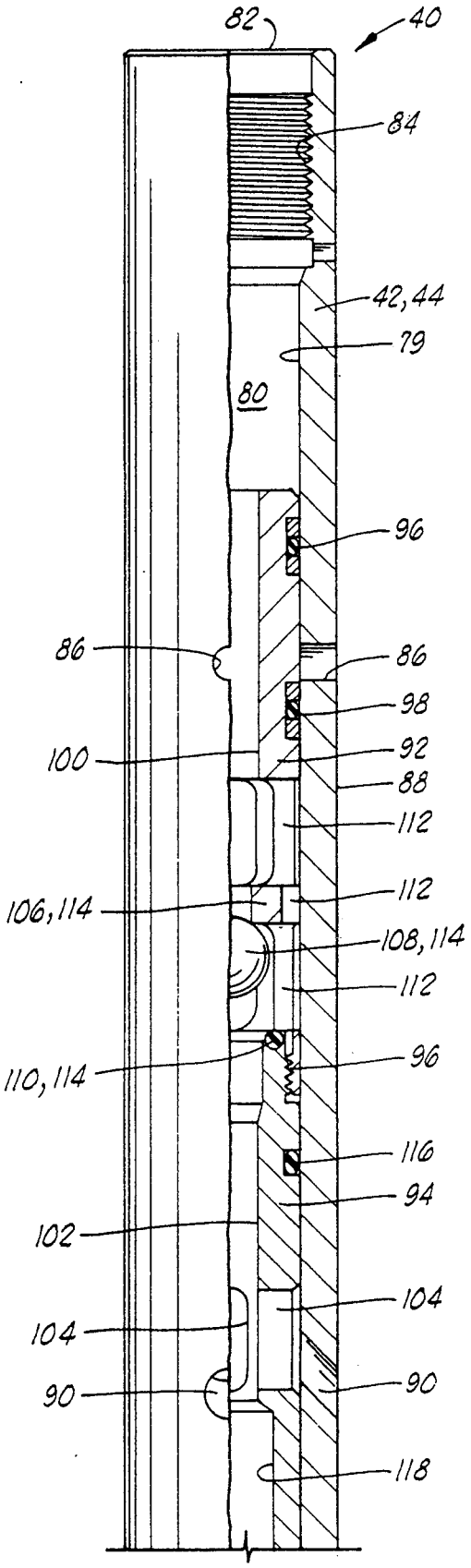

Relief valve sleeve 92 and actuator sleeve 94 are shown in FIG. 2A in their initial position as they would be in when the apparatus 40 is run into the well 10. In this initial position, relief valve sleeve 92 has upper and lower O-ring seals 96 and 98 located above and below the relief ports 86, respectively, so that the relief ports 86 are blocked by the relief valve sleeve 92.

Relief valve sleeve 92 and actuator sleeve 94 have bores 100 and 102, respectively, defined therein which are communicated with each other and communicated by the bore 79 with the open upper end 82 of housing 42.

Actuator sleeve 94 has a plurality of ports 104 defined radially therethrough which are aligned with the run-in fill ports 90 so that well fluids from the well 10 surrounding the housing exterior 88 may flow through the fill ports 90 and ports 104 into the actuating chamber 80 and up into the tubing bore of coiled tubing string 30 to fill the coiled tubing string 30 as it is run into the well.

Relief valve sleeve 92 has a retaining cage member 106 defined therein which retains a ball check 108 in place therebelow. The upper end of actuator sleeve 94 carries an O-ring seat 110 for the ball check 108.

In FIG. 2A, the ball check 108 is seen in an uppermost or open position against the cage 106 as it would be in when well fluid is running through the ports 90 and 104 and up through the bores 102 and 100 to fill the coiled tubing string 100. This fluid flows around the ball check 108 through an irregular passageway 112 which generally flows out around and back in past the cage 106.

As further described below with regard to FIGS. 3A–3G, when pressure is subsequently applied to the tubing bore of coiled tubing string 30, the ball check 108 will immediately fall downward against the seat 110 to prevent flow of fluids downward past the ball 108.

The ball check 108, seat 110 and retaining cage 106 may be collectively referred to as a one-way check valve 114 disposed in the housing interior or actuating chamber 80 for allowing well fluid from the well to fill the tubing bore of the coiled tubing string 30 as the sampling apparatus 40 is run into the well bore 12 on the coiled tubing string 30, and for subsequently isolating the tubing bore of coiled tubing string 30 from the well bore 12 when pressure in the tubing bore exceeds the pressure in the well bore.

The actuator sleeve 94 carries an O-ring seal 116 which seals against bore 79 of upper actuator housing section 44 below the check valve means 114.

The actuator sleeve 94 has a lower enlarged diameter sleeve bore 118 defined in its lower end. An actuator shaft 120 has its upper end received in lower sleeve bore 118 and the two pieces are held together by a plurality of shear pins 122.

The actuator shaft 120 has a cylindrical outer surface 124 closely received within a lower bore 126 of upper actuator housing section 44 with an O-ring seal 128 provided therebetween.

A radially outward extending annular flange portion 130 of actuator shaft 120 has an enlarged diameter cylindrical outer surface 132 closely received within a bore 134 of lower actuator housing section 46 with an O-ring seal 136 provided therebetween. Below flange 130 the lower portion of cylindrical outer surface 124 of actuator shaft 120 is received within a reduced diameter bore 138 of lower actuator housing section 46 with an O-ring seal 140 provided therebetween.

Figure 2B:
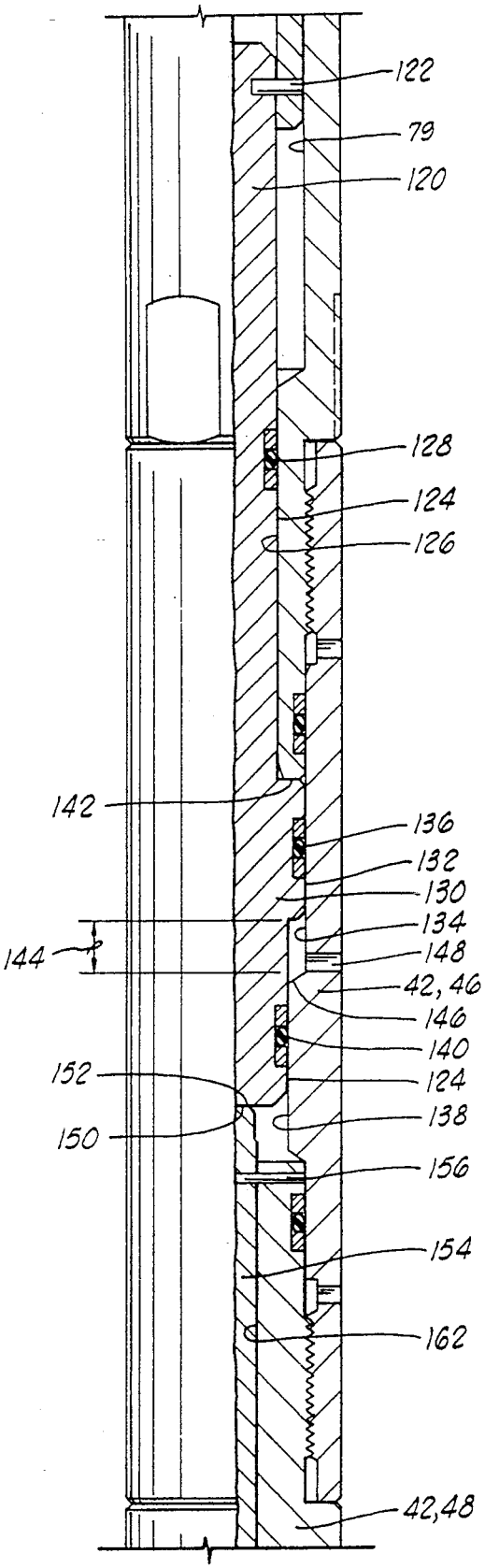
Figure 2C:
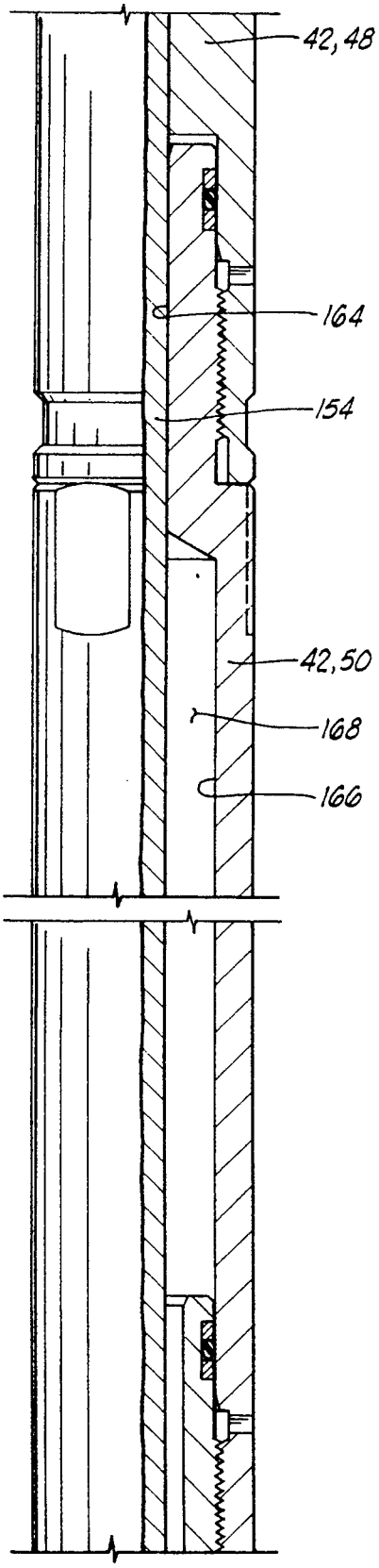

As is apparent in FIG. 2B, in its initial position, the actuator shaft 120 has its flange 130 abutting a lower end 142 of upper actuator housing section 44. The flange 130 is spaced by a distance 144 from an upward facing shoulder 146 of lower actuator housing section 46. As is further described below, this will allow a travel through the distance 144 by the actuator shaft 120, actuator sleeve 94 and relief valve sleeve 92 as those components move from the position of FIGS. 2A–2D to the position of FIGS. 3A–3D. Relief holes such as 148 prevent hydraulic blockage of that travel.

A lower end 150 of actuator shaft 120 abuts an upper end 152 of a first actuator rod 154. The first actuator rod 154 is initially retained in the position of FIGS. 2B–2D relative to first actuator rod housing section 48 by a plurality of shear pins 156.

In this initial position of first actuator rod 154, its abutment with the actuator shaft 120 holds the actuator shaft 120, actuator sleeve 94 and relief valve sleeve 92 in their initial positions illustrated in FIGS. 2A–2B.

In the embodiment illustrated in FIGS. 2A–2L, those portions of the sampler apparatus 40 located below the lower actuator housing section 46 make up a tandem sample chamber. As is further explained below, a single sample chamber or more than two sample chambers could be provided.

Those components contained in the upper and lower actuator housing sections 44 and 46 as just described make up a hydraulic actuator which will actuate the sampling devices located therebelow in response to an increase in fluid pressure applied to the tubing bore of coiled tubing string 30.

In that regard, the entire assembly of relief valve sleeve 92, actuator sleeve 94 and actuator shaft 120, along with the one-way check valve 114 may be said to make up an actuator piston or hydraulic actuator device which will provide a downward force on first actuator rod 154 to shear the shear pins 156 when fluid pressure within the tubing bore of coiled tubing string 30 reaches a first value as determined primarily by the selection and construction of the shear pins 156. It will be understood that the pressure within the tubing bore of coiled tubing string 30 acts downward across the entire circular area defined within the O-ring seal 116 as it contacts bore 79 below the check valve 114. There will be to some extent offsetting upward fluid forces acting on certain portions of this assembly due to well fluid in contact therewith. Thus, the actuating pressure in the tubing bore of coiled tubing string 30 will have to exceed the exterior well fluid pressure by a first value determined by shear pins 156 to push downward on that assembly with sufficient force to shear the shear pins 156.

Before continuing with a description of the operation of the sampling devices of sampling apparatus 40 located below the lower actuator housing section 46, it is convenient to describe the operation of the actuator assembly just described with reference to the subsequent positions shown in FIGS. 3 and 4, respectively.

Figure 3A:
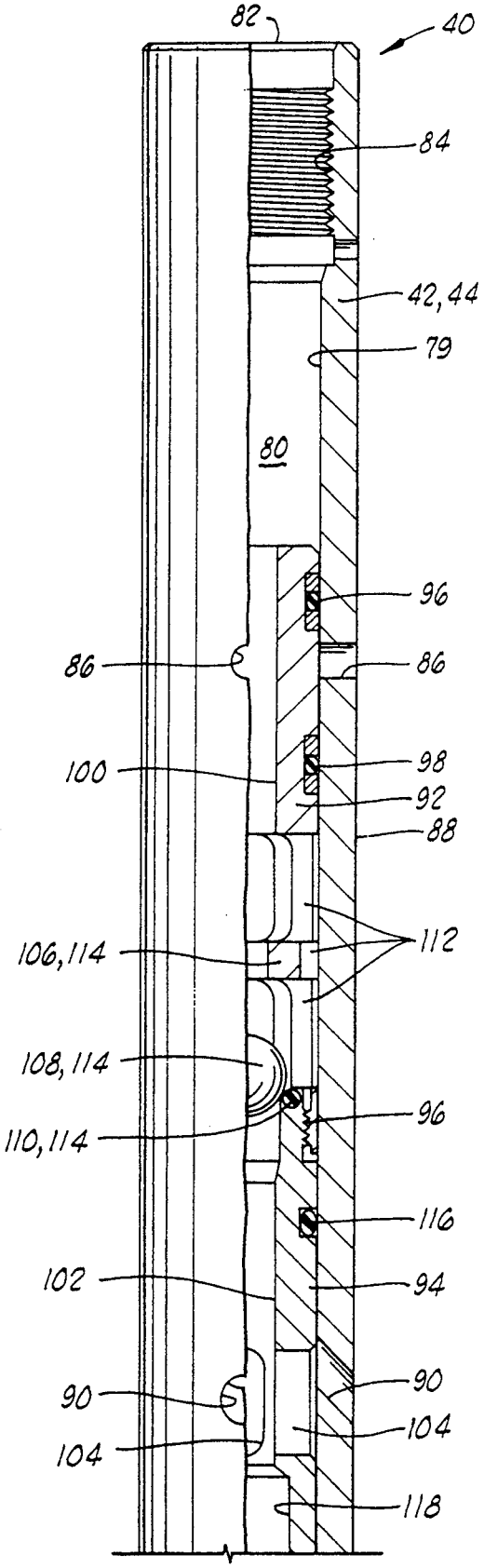
FIGS. 3A–3G comprise a view similar to FIGS. 2A–2G of the upper portion of the apparatus of FIGS. 2A–2L showing the sampling apparatus in an intermediate position wherein the sampling tool has been actuated, and a sample is flowing into the sample chamber.
Figure 3B:
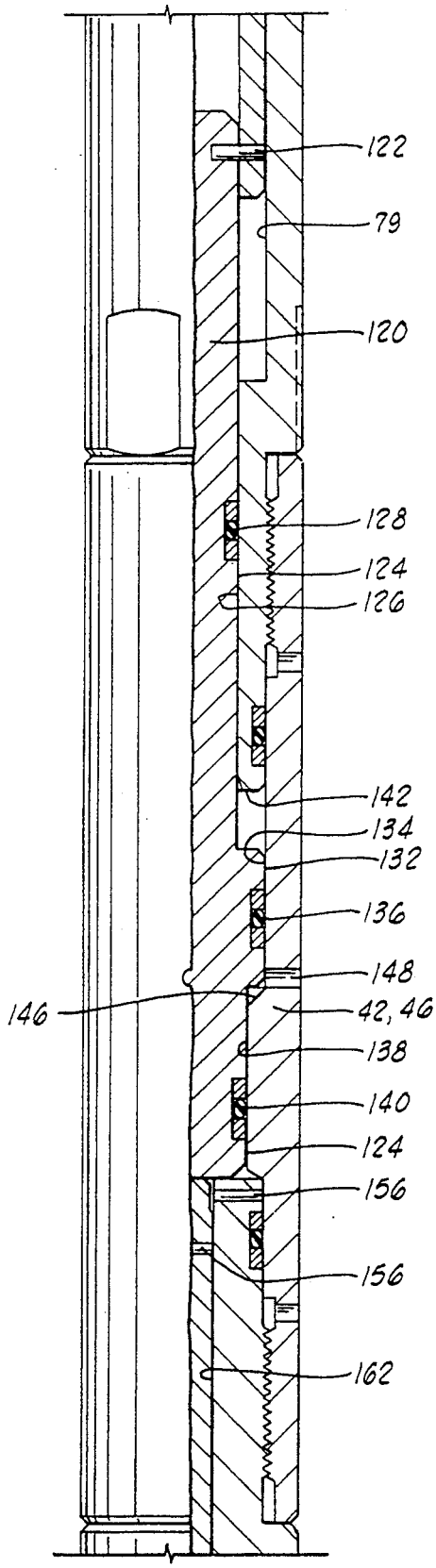
Figure 3C:
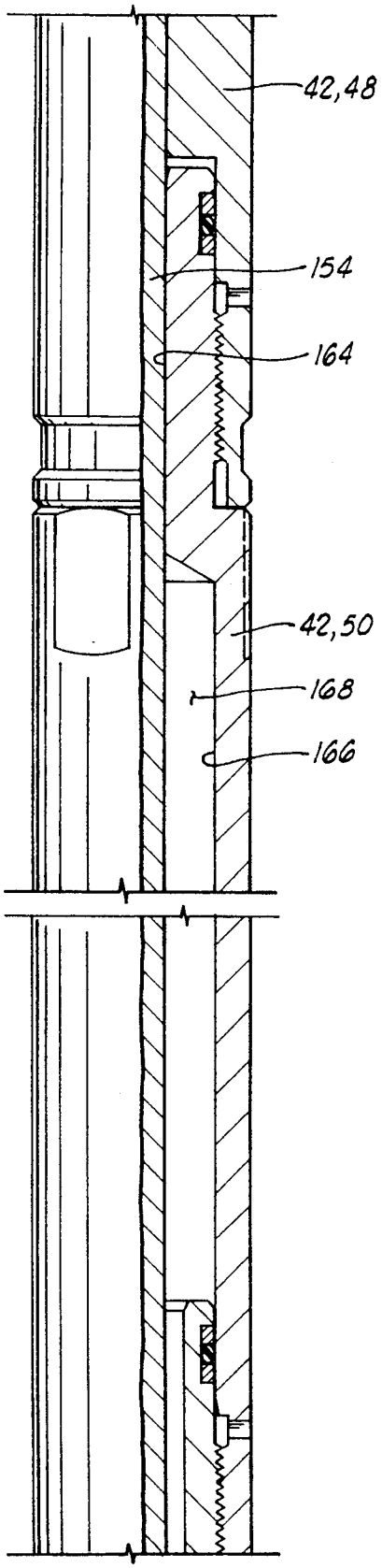

FIGS. 3A–3G illustrate an intermediate position of the sampling apparatus 40. In FIGS. 3A–3D, sufficient pressure has been applied to the tubing bore of coiled tubing string 30 to shear the shear pins 156 and move the actuator shaft 120, actuator sleeve 94 and relief valve sleeve 92 downward through the travel 144 until the shoulder 130 of actuator shaft 120 bottoms out against upward facing shoulder 146 of lower actuator housing section 46 as seen in FIG. 3B, or until lower end 150 of actuator shaft 120 abuts the upper end of first actuator rod housing section 48. It is apparent that this downward movement also forces the first actuator rod 154 downward through that same distance 144, which as further described below will actuate the first one of the tandem sample chambers.

In the intermediate position of FIG. 3A, the relief ports 86 are still closed by the relief valve sleeve 92.

Figure 4A:
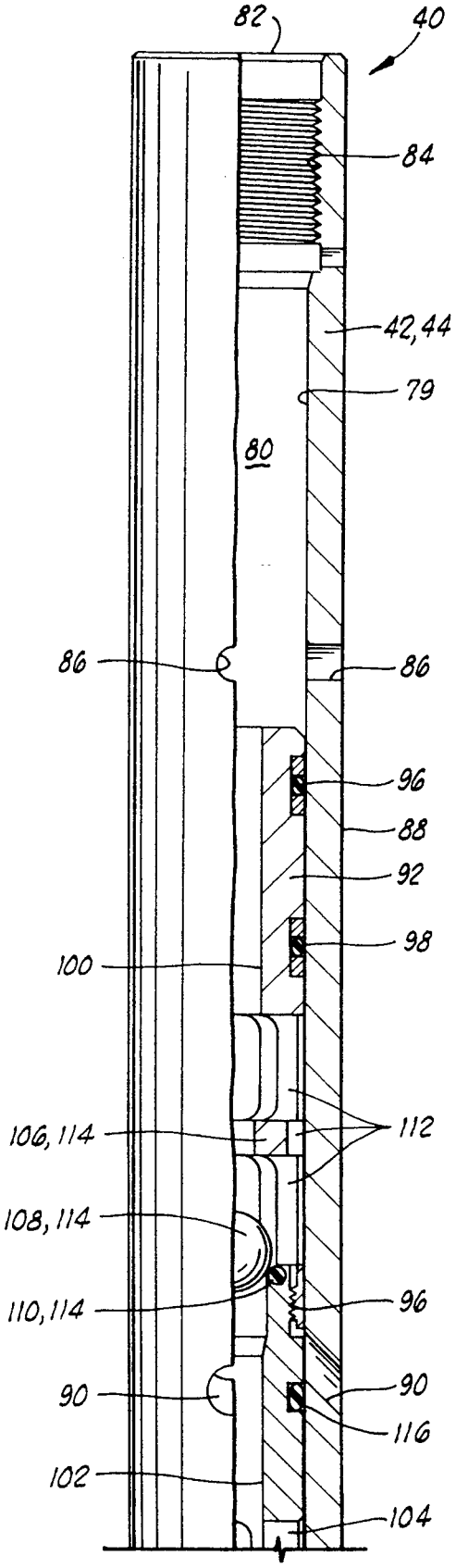
FIGS. 4A–4G comprise an elevation partly sectioned view similar to FIGS. 2A–2G again of only the upper portion of the tool showing the tool in a final position wherein the sample chamber is closed trapping a sample therein and wherein a relief valve has opened to allow the coiled tubing string to drain as the coiled tubing string and sampler apparatus are retrieved from the well.
Figure 4B:
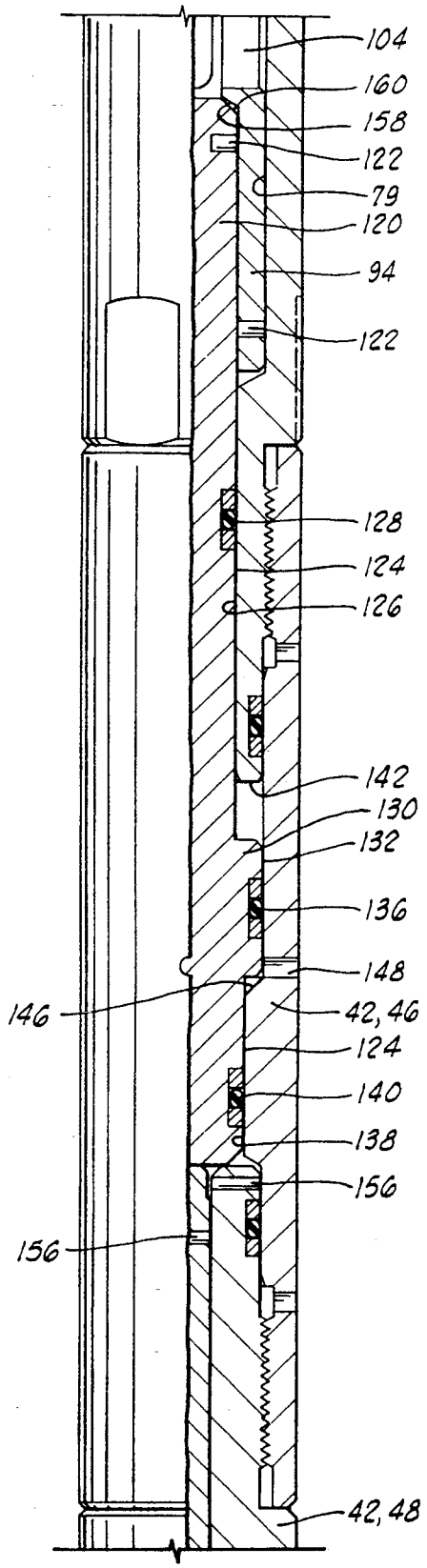
Figure 4C:
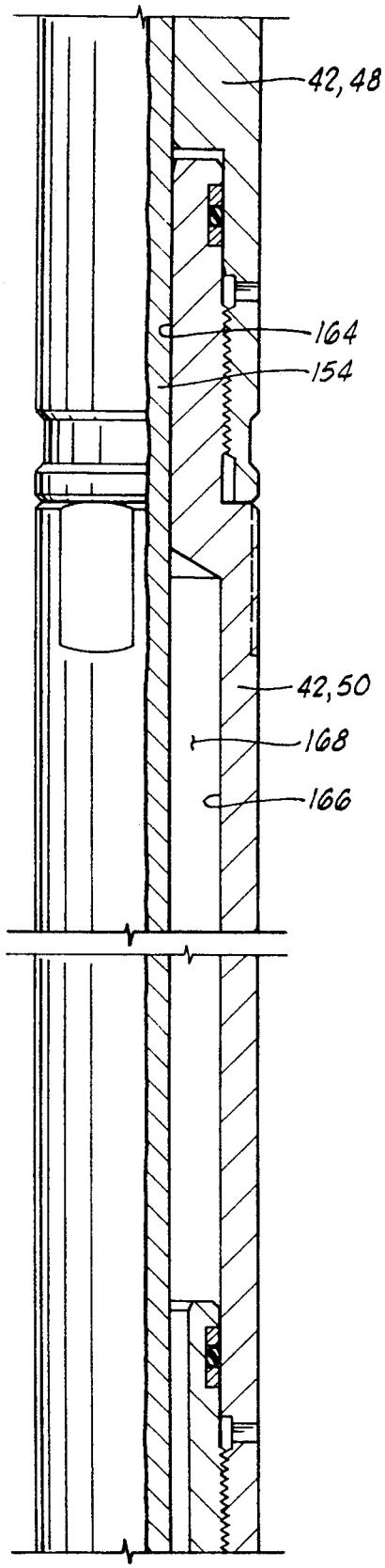
Figure 4D:
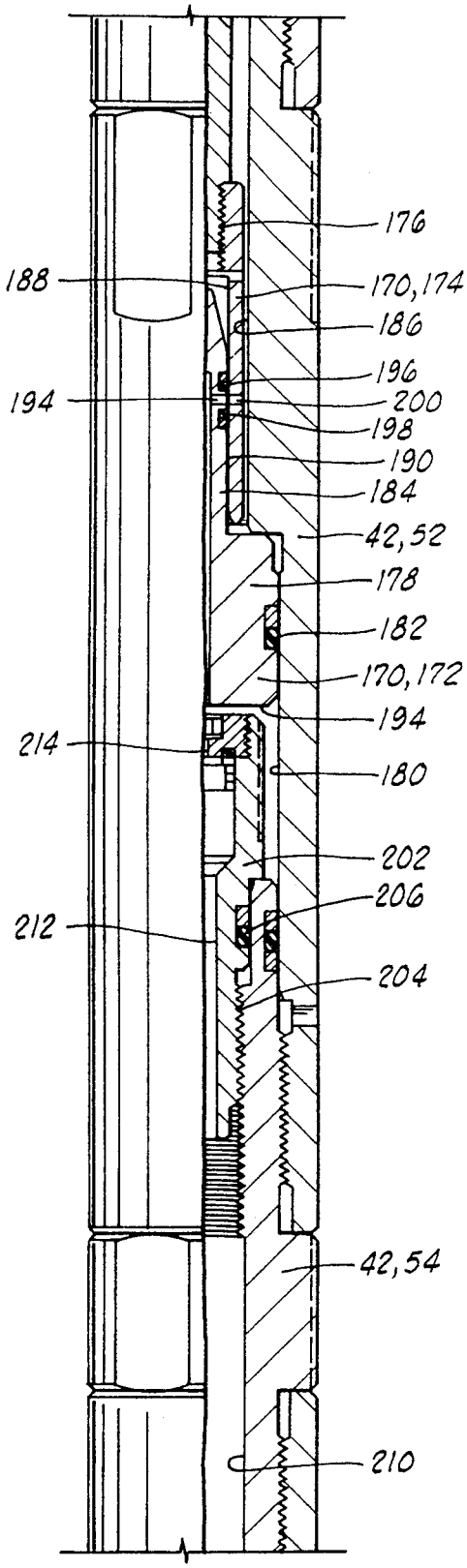

Continued application of increasing internal pressure to the tubing bore of coiled tubing string 30 will cause the shear pins 122 initially holding the actuator sleeve 94 in place relative to actuator shaft 120, thus allowing actuator sleeve 94 and relief valve sleeve 92 to continue moving downward from the position of FIGS. 3A–3B to the position of FIGS. 4A–4B wherein a downward facing shoulder 158 of actuator sleeve 94 abuts a chamfered edge 160 at the upper end of actuator shaft 120. In this final position of actuator sleeve 94 and relief valve sleeve 92, the uppermost seal 96 of relief valve sleeve 92 has moved below the relief ports 86 thus communicating the actuating chamber 80 with the exterior surface 88 of housing 42. This relieves pressure from the coiled tubing string 30 and upon subsequent retrieval of the coiled tubing string 30 and sampler apparatus 40 will allow well fluid to drain from the coiled tubing string 30 back into the well bore 12.

The relief valve sleeve 92 and actuator sleeve 94, and their frangible connection to actuator shaft 120 by shear pins 122, in combination with the relief ports 86 can be described as providing a relief and drain valve means for relieving pressure from the tubing bore of coiled tubing string 30 to the well bore 12 when pressure in the tubing bore exceeds pressure in the well bore by a second value greater than the first valve at which the shear pins 156 initially shear to allow actuation of the sampling device located therebelow. This second value is determined by the selection of shear pins 122. This relief and drain valve means also allows fluid to drain from the tubing bore of the coiled tubing string 30 when the sampling apparatus 40 and coiled tubing string 30 are retrieved from the well.

The relief valve sleeve 92 and actuator sleeve 94 collectively can be referred to as a sliding sleeve valve 92, 94 received within the housing interior 80 and slidable from the first position shown in FIGS. 2A–2B when the relief ports 86 are closed to the second position shown in FIGS. 4A–4B wherein the relief ports 86 are open. This sliding sleeve valve can be said to carry the check valve means 114 therein.

The shear pins 122 can be generally described as a releasable attachment means 122 for initially releasably attaching the actuator sleeve 94 and relief valve sleeve 92 to the actuator shaft 120 and for releasing the actuator sleeve 94 and relief valve sleeve 92 from the actuator shaft after the sampling device located therebelow is actuated and before the relief ports 86 are opened.

Returning now to FIGS. 2A–2L, the tandem sampling devices located below the actuator housing 44, 46 will be described.

The first actuator rod 154 is a solid cylindrical member, the upper portion of which is slidably received within a bore 162 of first actuator rod housing section 48 and a bore 164 of first dump chamber housing section 50. The lowermost portion of first actuator rod 154 extends through an enlarged inner diameter bore 166 of first dump chamber housing section 50 so that a lengthy annular chamber 168 is defined therebetween. As is further explained below, the annular chamber 168 upon initial assembly of the tool will be preferably filled with air or other gas at atmospheric conditions and thus will define a low pressure zone or low pressure chamber 168 within the tool 40.

The lower end of first actuator rod 154 is associated with a first hydraulic blocking valve 170 made up of a valve spool 172 and valve sleeve 174. The first actuating rod 154 is attached to the valve sleeve 174 at threaded connection 176 so that valve sleeve 174 moves with first actuating rod 154.

The valve spool 172 has an enlarged diameter portion 178 which is closely received within a bore 180 of the first blocking valve housing section 52 with an O-ring seal 182 provided therebetween. A proximally extending neck portion 184 of valve spool 172 extends upward or proximally into a reduced diameter bore 186 of first blocking valve housing section 52, with a sufficient annular space therebetween to receive valve sleeve 174.

The valve sleeve 174 has an inner bore 188 closely received about a cylindrical outer surface 190 of neck portion 184.

Valve spool 172 includes a relatively small axial passage 192 extending from its distal end 194 to a blind end within the neck portion 184. A plurality of radial ports such as 194 communicate axial passage 192 with cylindrical outer surface 190 between a pair of annular O-rings 196 and 198 which circumscribe outer surface 190.

Figure 2D:
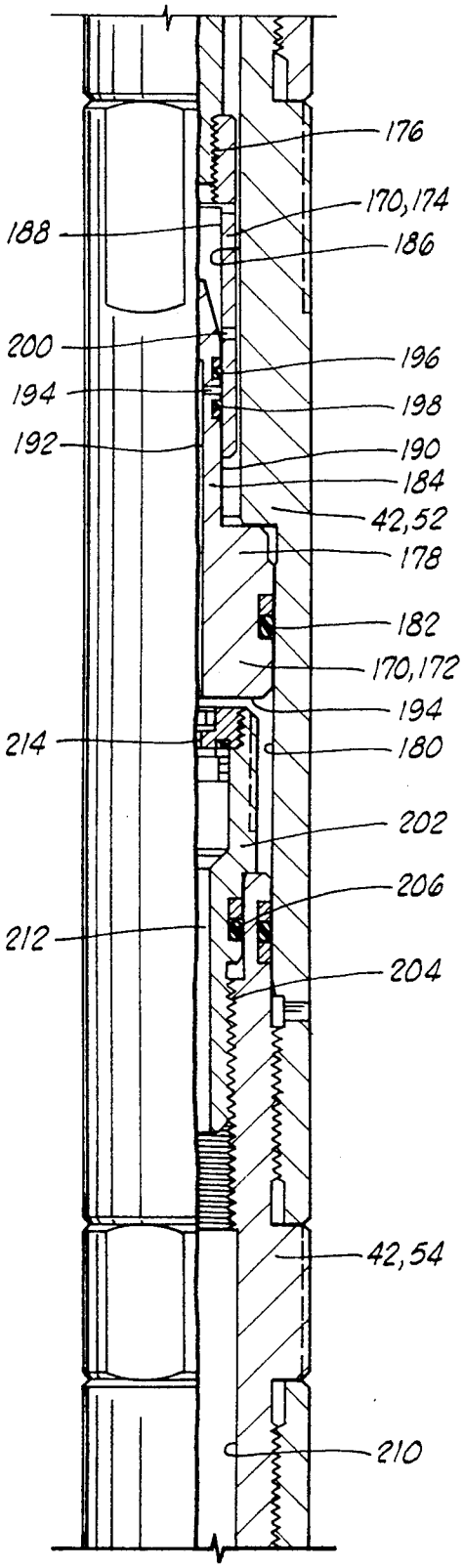

In the initial position of the blocking valve 170 seen in FIG. 2D, the radial ports 194 are blocked by the valve sleeve 174.

The valve sleeve 174 includes a plurality of sleeve ports 200. When the first actuating rod 154 moves downward through a distance substantially the same as travel 144 when actuator shaft 120 shears the shear pins 156, the valve sleeve 174 of blocking valve 170 will move downward through that same distance which will place the sleeve ports 200 between O-rings 196 and 198 and thus in registry with the radial ports 194 of valve spool 172 thus providing an open flow passage through the blocking valve 170 to the low pressure zone 168. As is further described below, this will allow the flow of hydraulic fluid through the blocking valve 170 which subsequently will allow the sampling tool located therebelow to move through appropriate positions such as to draw in and trap a sample of well fluid.

Located below the hydraulic blocking valve 170 is an orifice carrier 202 which is attached to first orifice housing section 54 at threaded connection 204 with an O-ring 206 being provided therebetween.

The first oil housing section 56 has an oil chamber 208 defined therein which is filled with a hydraulic fluid such as silicon oil or other hydraulic oil. The first orifice housing section 54 has an axial bore 210 defined therein which is communicated with oil chamber 208 and which is also filled with the hydraulic fluid.

The orifice carrier 202 has an axial passage 212 defined therein which is also communicated with the axial bore 210 of first orifice housing section 54 and thus is filled with the hydraulic fluid.

The proximal end of orifice carrier 202 has a relatively small orifice 214 defined therein which is communicated with the axial passage 212.

As will be further described below, the hydraulic fluid contained in oil chamber 208 will be substantially at the pressure of well fluid contained within the well bore 12 and thus will be at a much higher pressure than is the gas trapped in low pressure zone 168. Thus when the hydraulic blocking valve 170 is opened, oil from oil chamber 208 will slowly meter through the small orifice 214 and will flow through the blocking valve 170 into the low pressure zone 168. As further described below, this relatively slow controlled metered flow of oil will permit a controlled relatively slow movement of the components located therebelow which allow a well fluid sample to flow into a sample chamber and subsequently be trapped therein.

Received within the lower portion of first oil housing section 56, the first sample valve housing section 58, and the upper portion of first sample chamber housing section 60 is a sampler valve spool assembly 216 having an upper spool portion 218 and a lower spool portion 220 joined together at threaded connection 222.

The upper portion 218 of sampler valve spool assembly 216 includes an enlarged diameter uppermost cylindrical outer surface 224 closely received in an enlarged diameter bore 226 of first oil housing section 56 with an O-ring seal 228 provided therebetween. A lower smaller diameter cylindrical outer surface 230 of upper spool portion 218 is closely received within a reduced diameter bore 232 with an O-ring seal 234 provided therebetween.

Figure 2E:
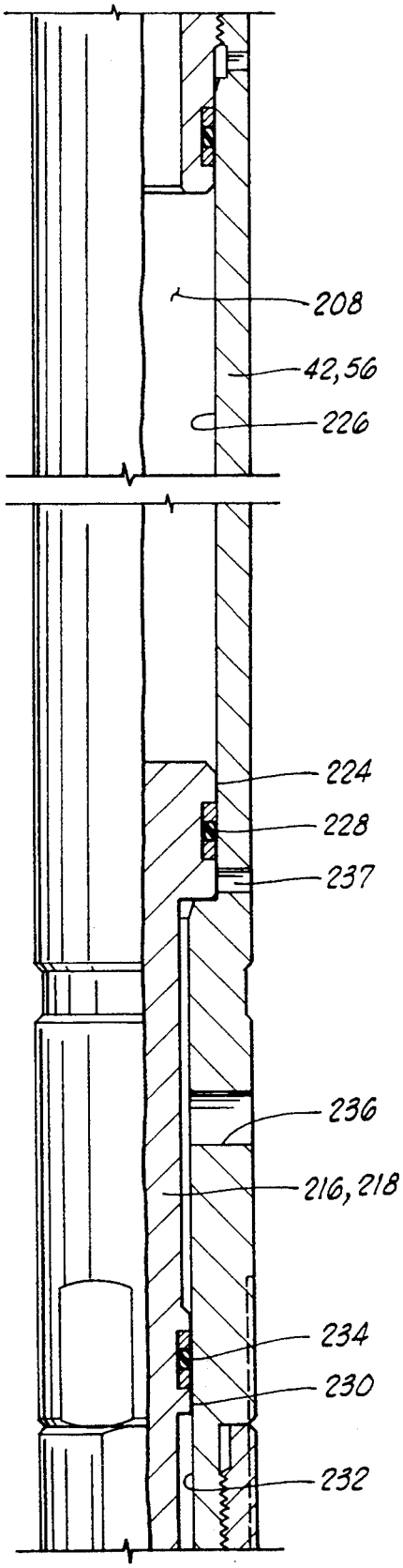
Figure 2F:
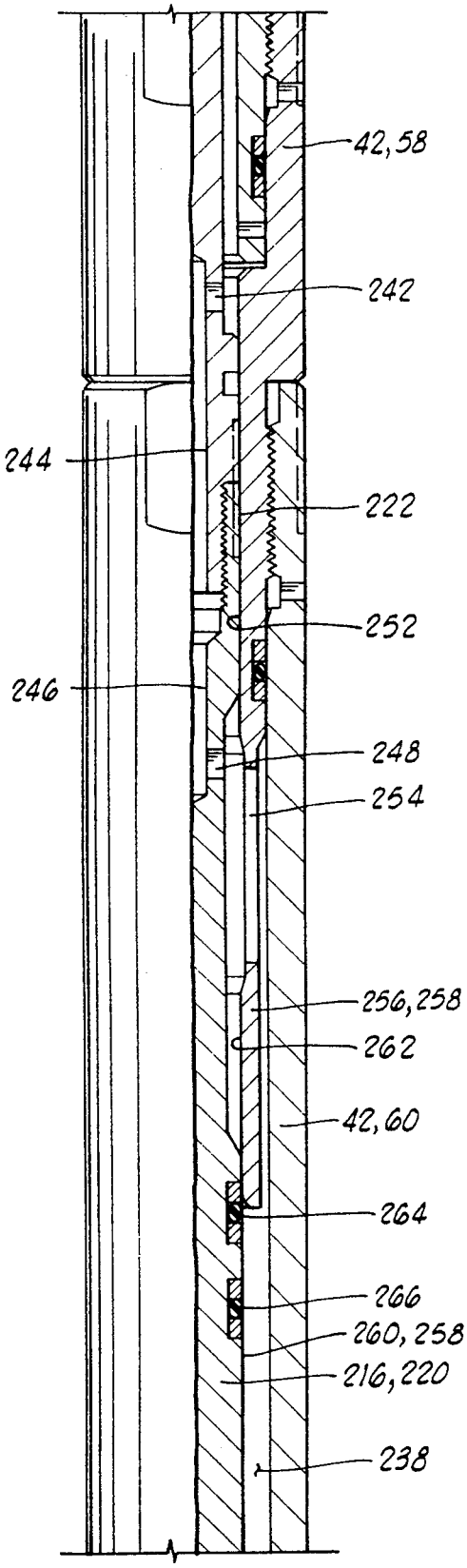
Figure 3D:
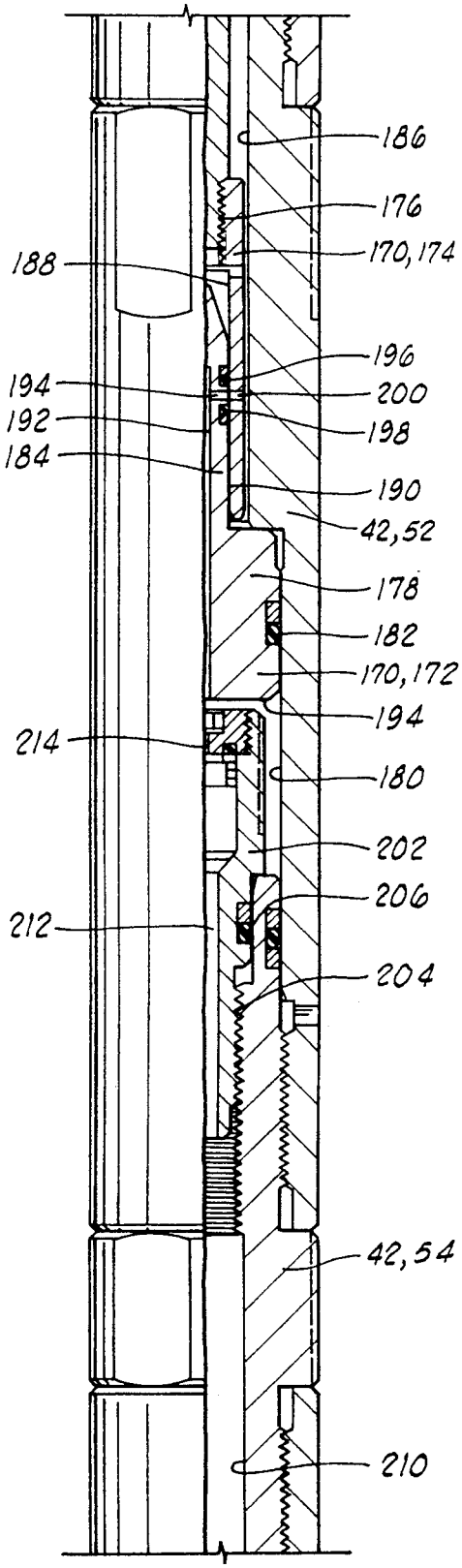
Figure 3E:
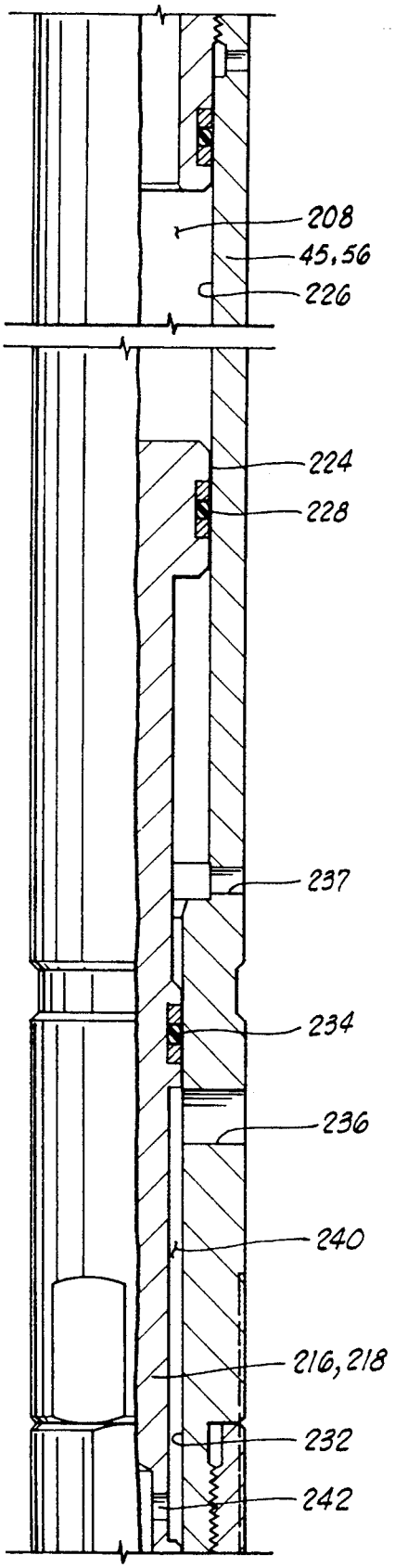
Figure 3F:
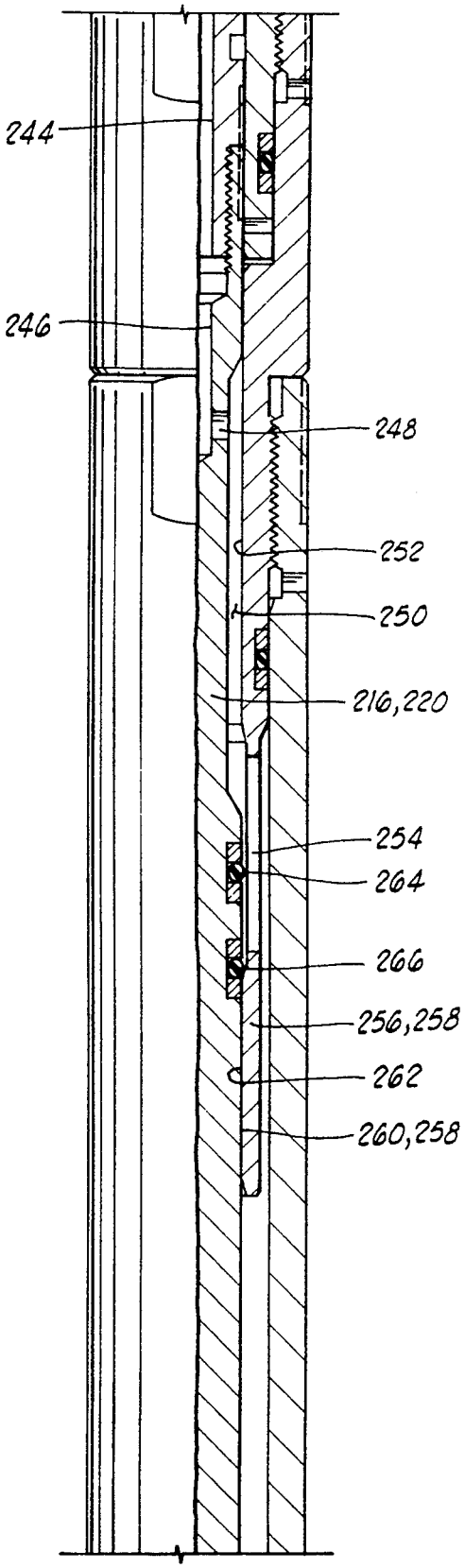

The first oil housing section 56 has a plurality of sample fill ports 236 defined radially therethrough communicated with the smaller diameter bore portion 232 thereof. When the sample valve spool assembly 216 is in its initial position shown in FIGS. 2E–2F, the fill ports 216 are located between O-ring seals 228 and 234 and thus are closed. Due to the differential area between O-ring seals 228 and 234 it will be apparent that there will be an upward acting pressure differential on the sampler valve spool assembly 216 due to hydraulic pressure entering the sampler fill ports 236. So long as the hydraulic blocking valve 170 is closed, the sampler spool valve assembly 216 is hydraulically blocked from upward movement due to the fact that the oil chamber 208 is filled with a relatively incompressible hydraulic oil. When the blocking valve 170 is opened, oil from oil chamber 208 will begin to slowly flow outward through the metering orifice and thus will allow a slow upward movement of sampler valve spool assembly 216 relative to the housing 42. FIGS. 3E–3F illustrate the sampler valve spool assembly at an intermediate position in its upward travel wherein the O-ring 234 has moved upward past sample valve fill ports which will allow well fluid to then begin to fill a sample chamber 238. The well fluid entering sample fill ports 236 flows to sample chamber 238 through a relatively distorted path which may be referred to as a sampling passage. First the fluid enters an annular space 240 defined between the upper portion of sampler spool valve assembly 216 and the bore 232. Fluid then flows inward through radial ports 242 of the upper spool portion 218 into an axial bore 244 of upper spool portion 218 from which it is communicated to an axial bore 246 of lower spool portion 220 and then flows outward through radial ports 248 of lower spool portion 220, then through an annular space 250 between lower spool portion 220 and a bore of first sample valve housing section 58, then through a plurality of radial slots 254 defined in an inner sleeve portion 256 of first sample valve housing section 58 and thus into the sample chamber 238. The inner sleeve portion 256 of first sample valve housing section 58 serves as part of a sample trapping valve 258. An enlarged diameter cylindrical outer surface 260 of lower spool portion 220 is closely received within a bore 262 of inner sleeve 256 and carries first and second O-rings 264 and 266 which seal between outer surface 260 and bore 262.

As is apparent in FIG. 3E, when the spool valve assembly 216 moves upward a sufficient distance to move seal 234 past sample fill ports 236, well fluid sample will begin flowing through the passage just described into the sample chamber 238 above a floating piston 268.

As the spool assembly 216 continues its slow controlled upward movement due to metering of oil through orifice 214, the well fluid sample will relatively quickly flow into the sample chamber 238 filling the sample chamber 238. As is apparent from comparing FIGS. 2G and 3G, as the well fluid sample flows inward, it will quickly move the floating piston 268 downward through the sample chamber 238. The sample chamber 238 below floating piston 268 will contain only air at atmospheric pressure upon assembly of the tool, and that air will be compressed and be of no consequence to the operation of the tool.

Figure 3G:
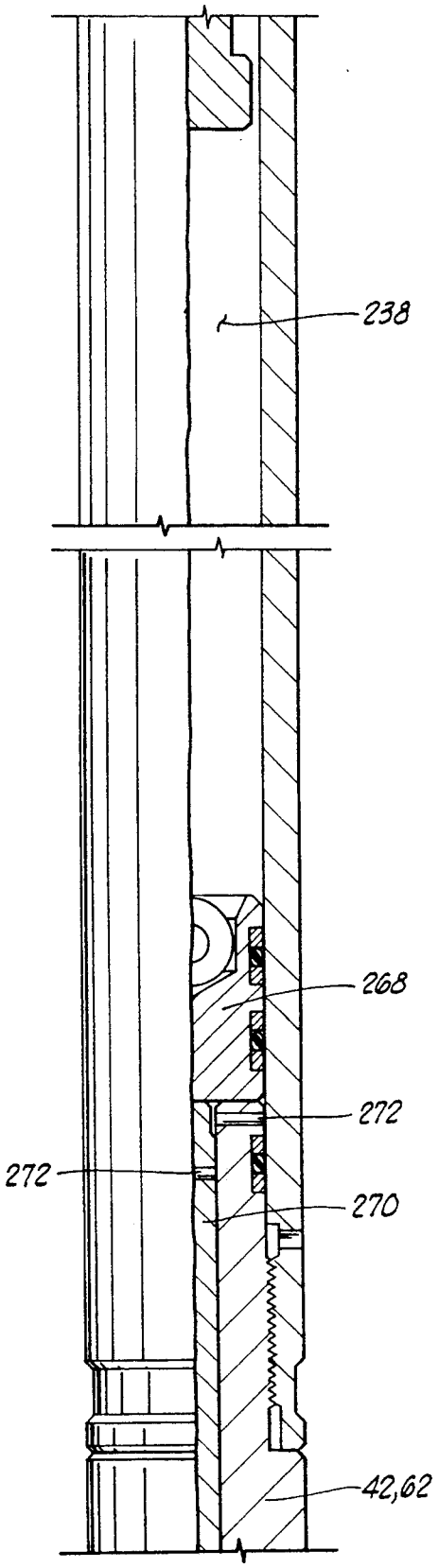

As is seen in FIG. 3G, the hydraulic pressure pushing strongly downward on floating piston 268 due to the pressure of well fluid in the well bore 12 will cause the floating piston 268 to push downward on a second actuating rod 270 thus shearing a second set of shear pins 272.

The second actuating rod housing section 62 and those components of tool 40 contained therein and located therebelow comprise a second sampling device substantially identical to the sampling device just described.

The second actuator rod 270 has its lower end connected to a second hydraulic blocking valve 274 including spool portion 276 and sleeve portion 278. Located below second hydraulic blocking valve 274 is a second orifice carrier 280 having a second orifice 282 defined therein. A second sampler valve spool assembly 284 has its upper power piston portion 288 and its lower sampler trapping valve portion 289. There is also a second floating piston 290.

Figure 2G:
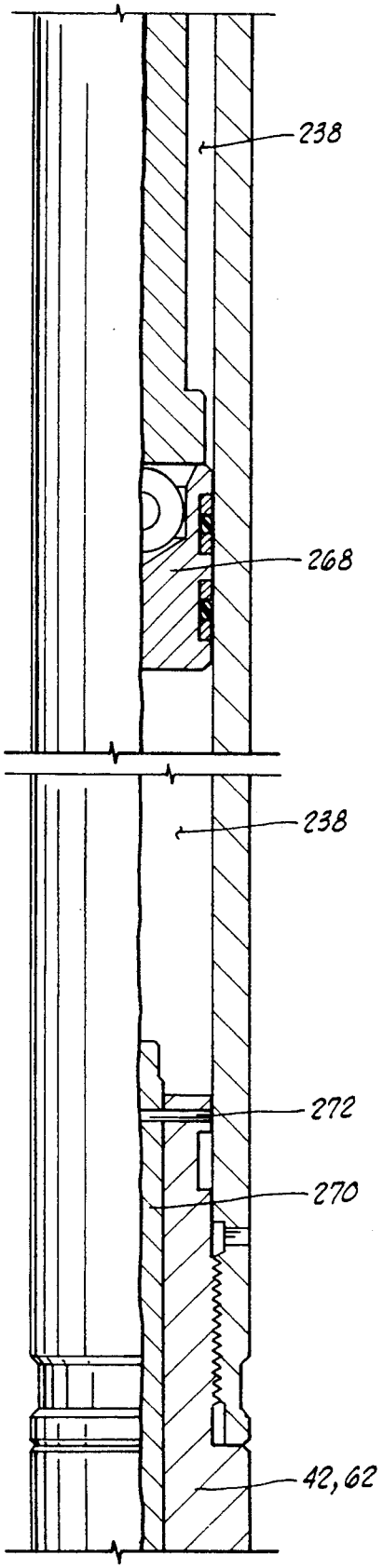

The floating piston 268 may be described as a displaceable member 268 which is moved from its first position of FIG. 2G to its second position of FIG. 3G as the first sample chamber 238 fills with a well fluid sample.

Figure 2H:
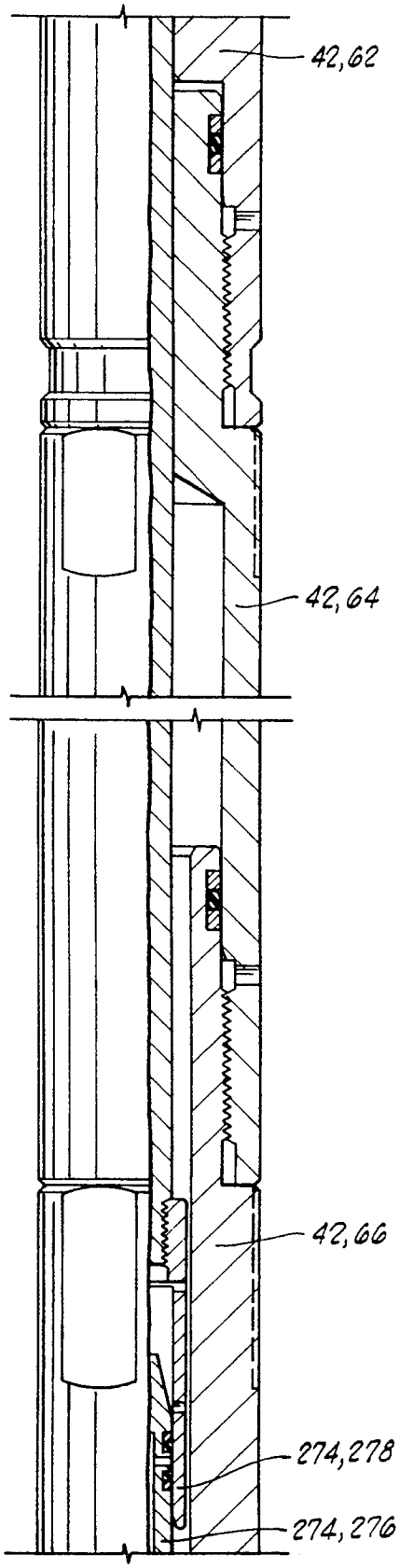
Figure 21:
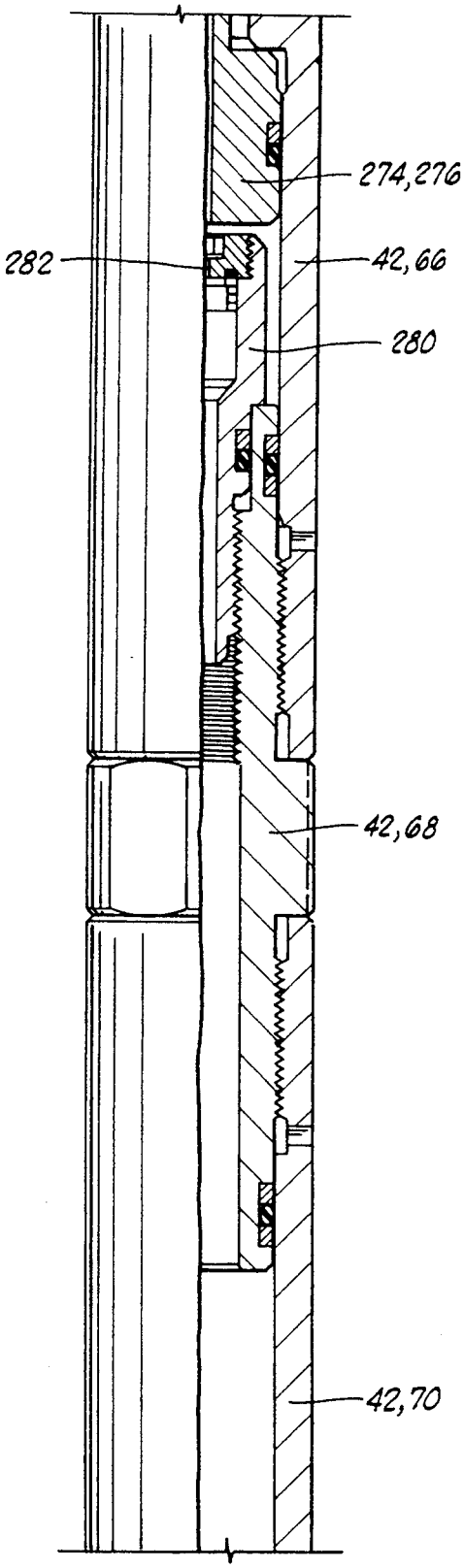
Figure 22:
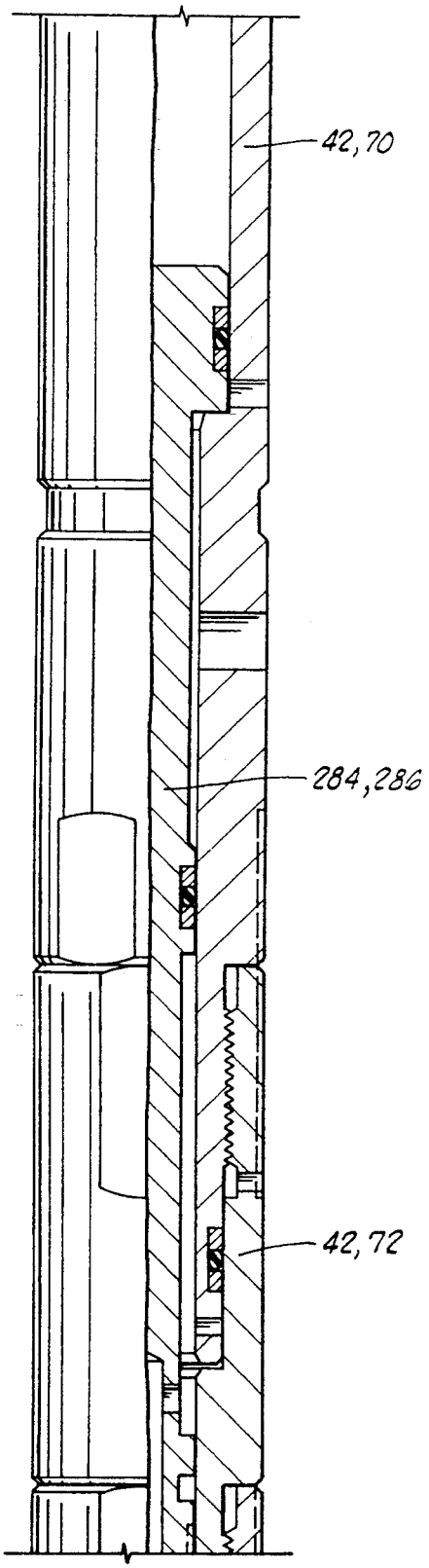
Figure 2K:
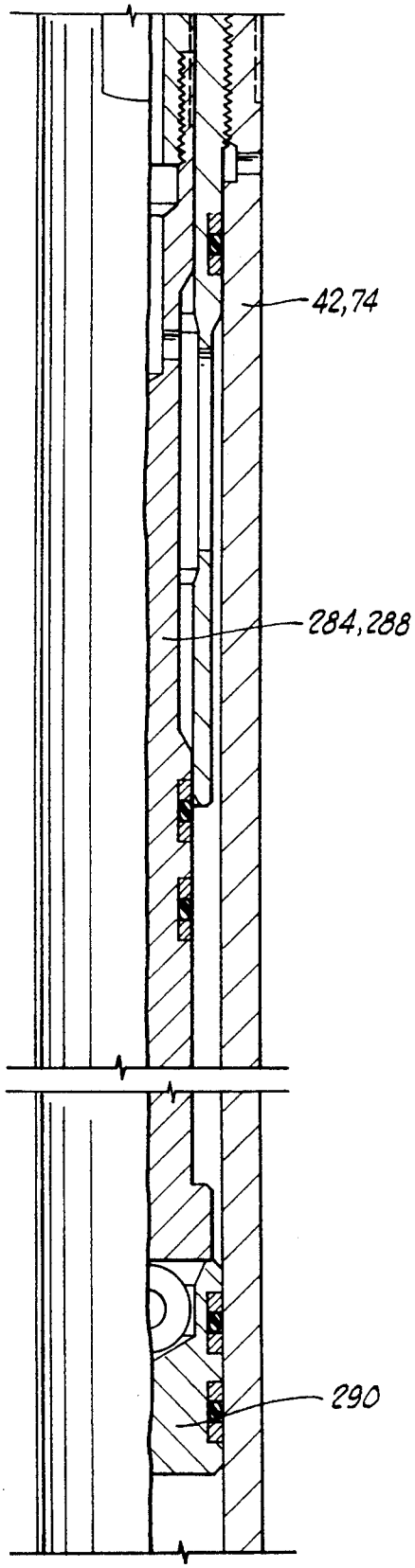
Figure 2L:
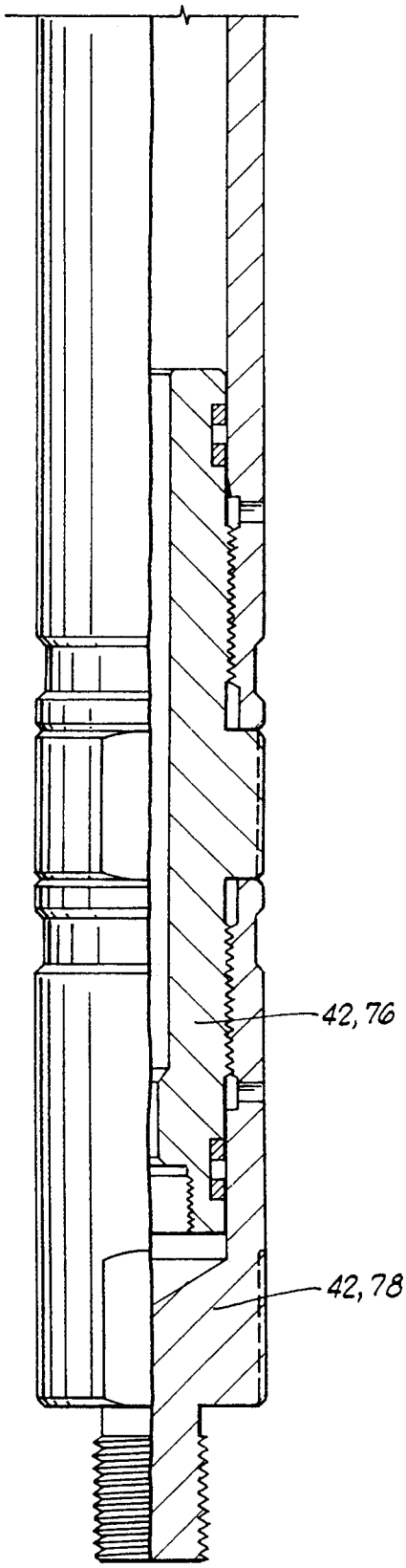

The second actuator rod 270 and second hydraulic blocking valve 274 may be referred to as an actuator assembly 270, 274 operably associated with the second sampler spool valve assembly 284 and with the displaceable member 268. The actuator assembly 270, 274 has an unactuated position as seen in FIGS. 2G–2I and an actuated position as seen in FIG. 3G. The displaceable member 268 and the actuator assembly 270, 274 are so arranged and constructed that the displaceable member 268 engages the actuator assembly 270, 274 and moves the actuator assembly 270, 274 to its actuated position as the displaceable member 268 moves from its first position of FIG. 2G to its second position of FIG. 3G.

Figure 4E:
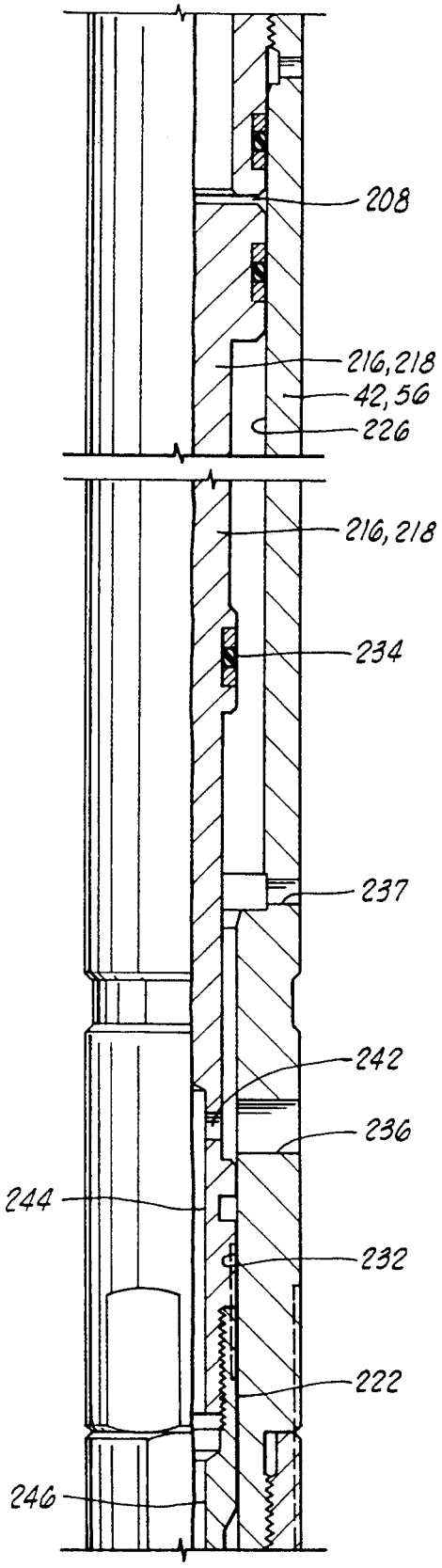
Figure 4F:
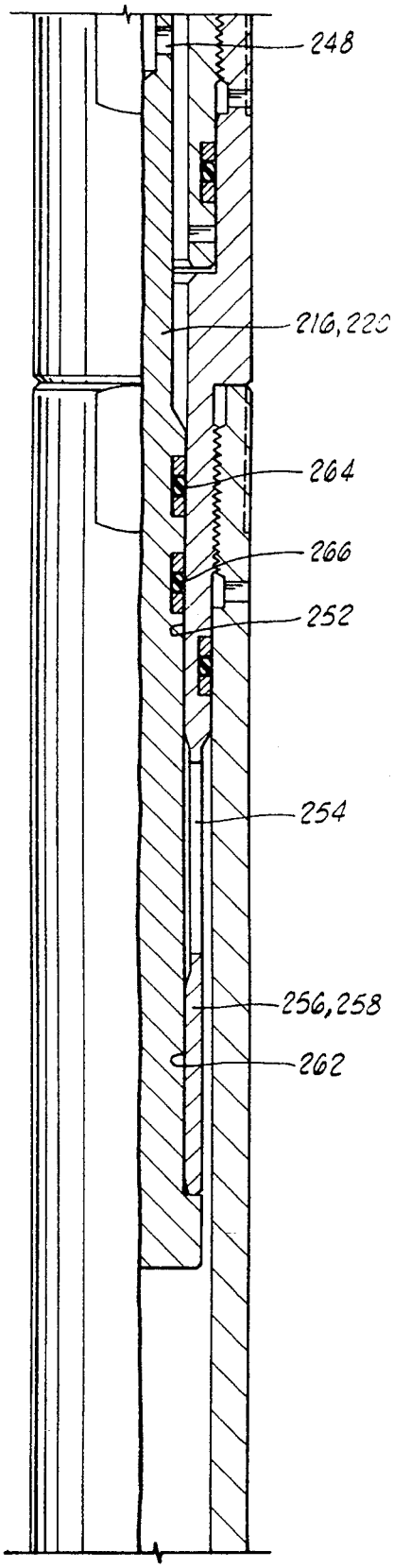
Figure 4G:
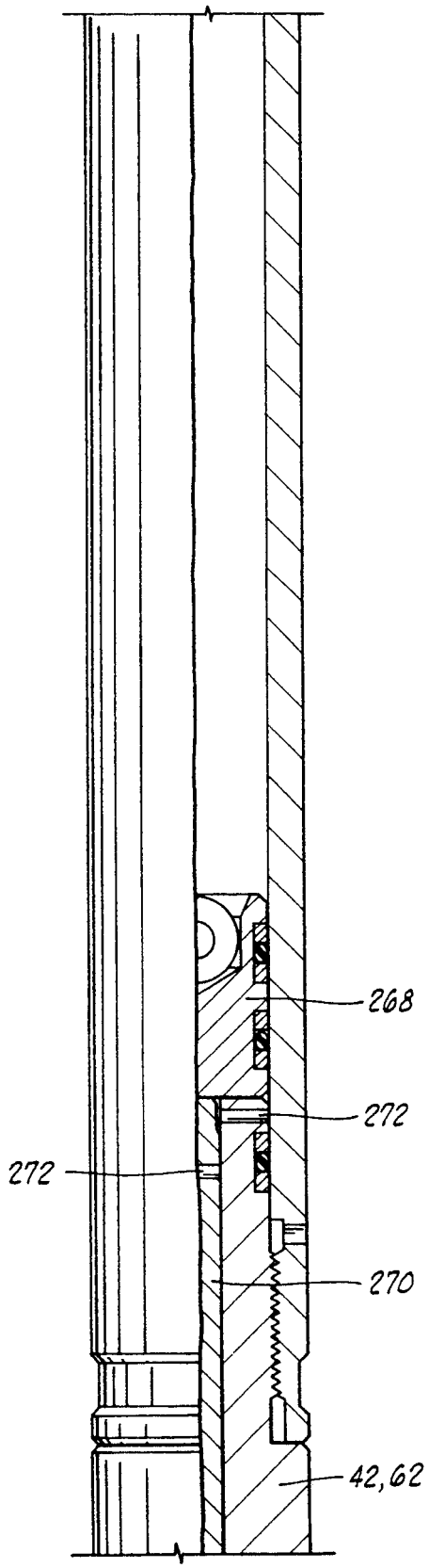

To continue the description of the trapping of the first sample, reference is made to FIGS. 3E–F and 4E–F. As the slow upward movement of spool assembly 216 continues, the O-rings 264 and 266 will move upward into bore 252 past the radial slots 254 thus trapping the well fluid sample in sample chamber 238 below the lowermost seal 266 when the spool valve assembly 216 comes to its final position as seen in FIGS. 4E–F.

The opening of blocking valve 170 can be generally described as releasing the spool assembly 216 from its initial position of FIGS. 2E–F so that it can move toward its intermediate position of FIGS. 3E–F wherein the sample can be drawn into the sample chamber 238, and so that it can subsequently move to its final position of FIGS. 4E–F wherein the sample is trapped in the sample chamber 238.

The spool assembly 216 can be referred to as a sampling valve assembly 216 received in the first oil housing section 56 and first sample valve housing section 58 of housing assembly 42. The differential area between seals 228 and 234 on upper portion 218 of spool assembly 216 can be described as defining a power piston associated with the assembly 216 which power piston has its lower side communicated with the housing exterior through fill port 236 and through a secondary power port 237 and having its opposite side communicated with the low pressure zone 168 through oil chamber 208, orifice 214 and hydraulic blocking valve 170.

The hydraulic blocking valve 170 can be generally described as being disposed hydraulically between the power piston defined on upper spool portion 218 and the low pressure zone 168. In its closed position of FIG. 2D, the hydraulic blocking valve 170 hydraulically blocks the spool assembly 216 from moving, and in its open position as shown in FIG. 3D, the hydraulic blocking valve 170 permits the spool assembly 216 to be moved upward by a differential pressure between the housing exterior and the low pressure zone 168. It will be understood that only a portion of this differential pressure is actually seen across the area between seals 228 and 234 since there is a substantial pressure drop through orifice 214.

Methods Of Taking Well Fluid Samples

Methods of taking well fluid samples using the apparatus 40 run on the coiled tubing string 30 can be generally described as follows.

The sampling tool 40 is run into the well 10 on the coiled tubing string 30.

As the coiled tubing string 30 and sampling tool 40 are run into the well, the coiled tubing string 30 is allowed to fill with well fluid through run-in fill ports 90 as is permitted by the one-way check valve means 114.

After the valve apparatus 40 is located at a desired position in the well at which it is desired to draw and trap a well fluid sample, such as for example the position illustrated in FIG. 1, this is accomplished by increasing tubing pressure within the coiled tubing string. In response to that increase in tubing pressure, several things happen.

First, the ball check valve means 114 will close thus closing the run-in fill ports 90. Then, when the downwardly acting pressure differential acting on the relief valve sleeve 92 and ball check 108 reaches a first value sufficient to shear shear pins 156, the actuator shaft 120 will push the first actuator rod 154 downward thus opening blocking valve 170 to actuate the sampling valves associated therewith. This actuation or initiation of the sampling operation can be described as beginning when the blocking valve 170 is opened. It will be understood that after the blocking valve 170 opens, a significant time on the order of fifteen to thirty minutes will pass as the spool assembly 216 moves upward allowing a sample to be drawn in and trapped in sample chamber 238.

Shortly after the initiation or actuation of the sampling device by opening of blocking valve 170, continued increase in pressure in the coiled tubing string 30 will cause the shear pins 122 to shear thus allowing the relief valve sleeve 92 and actuator sleeve 94 to move downward from the position of FIGS. 3A–3B to the position of FIGS. 4A–4B thus opening the drain ports 86 and thus communicating the tubing bore of coiled tubing string with the surrounding well bore.

Subsequently, the coiled tubing string 30 and sampling tool 40 are retrieved from the well 10 and as they are retrieved, fluids contained in the tubing bore of coiled tubing string 30 are allowed to drain therefrom through the drain ports 86.

When the sampling operation is conducted in a substantially deviated well having a horizontal well bore portion 18, the sampling tool 40 is run into the substantially horizontal bore portion 18 by pushing the sampling tool 40 with the coiled tubing string 30. Thus the apparatus disclosed herein is particularly useful in taking well fluid samples from substantially horizontal bore portions of wells.

Further, by using the tandem sampling apparatus shown in FIGS. 2A–2L, two fluid samples can be separately drawn and trapped at the same time. If more than two samples are desired, it will be apparent that additional sampling sections could be easily connected to the lower end of the tool 40 with each sequential lower section being triggered or actuated by downward movement of a floating piston such as floating piston 268 which actuates the second sampling device.

The system disclosed also allows easy and accurate control of the sampling operation since the sampling operation is performed in response to the application of an increase in fluid pressure to the coiled tubing string 30 by applying pressure thereto from pressure source 34 under control of valve 38 at the surface location.

One advantage of providing surface control of pressure actuation through applying pressure to the bore of coiled tubing string 30, as contrasted for example to the use of hydrostatic pressure in the well for actuation of the tool, is that in long horizontal sections the hydrostatic pressure of the well is substantially constant and thus cannot be relied upon to actuate the tool at a preferred position within the horizontal portion of the well.

Additionally, by providing surface control of actuation of the tool, the operator of the well can wait until the well is in exactly the condition which is desired to be sampled and then can rapidly cause the sample to be taken by pressuring up the tubing bore of coiled tubing string 30.

Due to the presence of one-way check valve 114 and run-in fill ports 90, as the coiled tubing string 30 is run into the well, it is allowed to fill with well fluid thus preventing collapse of the coiled tubing string 30 due to differential pressures acting thereacross. This one-way check valve means 114 immediately closes when pressure in the tubing bore of coiled tubing string 30 exceeds well bore pressure as shown in FIG. 3A. The closing of check valve means 114 can be described as isolating the tubing bore of coiled tubing string 30 from the well.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A method of collecting a well fluid sample from a well, comprising:

(a) running a sampling tool into a well on a coiled tubing string;

(b) actuating said sampling tool by increasing fluid pressure in said coiled tubing string;

(c) trapping said well fluid sample from said well in said sampling tool in response to said increasing of fluid pressure in said coiled tubing string, said step of trapping including moving a sampling valve to trap said sample by applying to said sampling valve a pressure differential between well fluid in said well and a lower pressure zone defined in said sampling tool; and (d) retrieving said coiled tubing string and said sampling tool containing said well fluid sample from said well.

2. The method of claim 1, wherein:
step (a) includes running said sampling tool into a horizontal portion of said well; and
step (c) includes trapping said well fluid sample from said generally horizontal portion of said well.

3. The method of claim 1, further comprising:
during step (a), filling said coiled tubing string with well fluid as said coiled tubing string is run into said well.

4. The method of claim 3, further comprising:
during step (b), isolating a tubing bore of said coiled tubing string from said well.

5. The method of claim 1, wherein:
step (b) includes opening a hydraulic blocking valve to allow fluid to flow into said low pressure zone.

6. The method of claim 1, further comprising:
after step (b), opening a relief port and communicating a tubing bore of said coiled tubing string with said well; and
during step (d), draining well fluid from said tubing bore through said relief port.

7. A method of taking a well fluid sample, comprising:
(a) running a sampling tool into a well on a coiled tubing string;
(b) during step (a), filling said coiled tubing string with well fluid through a fill port communicating a tubing bore of said coiled tubing string with said well;
(c) increasing tubing pressure in said coiled tubing string and in response to said increasing pressure:
(1) closing said fill port;
(2) actuating said sampling tool to trap a well fluid sample therein; and
(3) opening a drain port communicating said tubing bore with said well;
(d) retrieving said coiled tubing string and said sampling tool from said well; and
(e) during step (d), draining said tubing bore through said drain port.

8. The method of claim 7, wherein:
in step (a), said well includes a generally horizontal well bore portion, and said sampling tool is run into said substantially horizontal bore portion by pushing said sampling tool with said coiled tubing string.

9. The method of claim 8, wherein:
step (c) is performed while said sampling tool is located within said substantially horizontal bore portion.

10. The method of claim 7, wherein:
step (c)(2) includes trapping at least two separate well fluid samples.

11. The method of claim 7, wherein:
step (c) includes increasing said tubing pressure by applying pressure at a surface location to fluid standing in said coiled tubing string.

12. The method of claim 7, wherein:
step (b) includes filling said coiled tubing string through a one-way check valve connected to said fill port.

13. The method of claim 12, wherein:
step (c)(1) includes closing said fill port by closing said one-way check valve.

14. A coiled tubing conveyed sampling apparatus, comprising:
an actuator housing having a housing interior and having a proximal housing end including connector means for connecting said housing to a coiled tubing string so that a tubing bore of said coiled tubing string communicates with said housing interior;
check valve means, disposed in said housing interior for allowing well fluid from a well bore to fill said tubing bore of said coiled tubing string as said sampling apparatus is run into said well bore on said coiled tubing string, and for isolating said tubing bore from said well bore when pressure in said tubing bore exceeds pressure in said well bore;
a sampling tool attached to said actuator housing;
pressure responsive actuator means disposed in said housing interior for actuating said sampling tool in response to pressure in said tubing bore exceeding pressure in said well bore by a first value so that a well fluid sample is trapped in said sampling tool; and
relief and drain valve means for relieving pressur from said tubing bore to said well bore when pressure in said tubing bore exceeds pressure in said well bore by a second value greater than said first value, and for allowing fluid to drain from said tubing bore when said coiled tubing string and said sampling apparatus are retrieved from said well bore.

15. The apparatus of claim 14, wherein:
said relief and drain valve means includes a relief port defined in said actuator housing and a sliding sleeve valve received within said housing interior and slidable from a first position wherein said relief port is closed to a second position wherein said relief port is open; and
said check valve means is carried within said sliding sleeve valve.

16. The apparatus of claim 15, wherein:
said sliding sleeve valve and said check valve means comprise a part of said pressure responsive actuator means; and
said pressure responsive actuator means further includes:
an actuator shaft; and
releasable attachment means for initially releasably attaching said sliding sleeve valve to said actuator shaft and for releasing said sliding sleeve valve from said actuator shaft after said sampling tool is actuated and before said relief port is opened.

17. A coiled tubing conveyed sampling apparatus, comprising:
a coiled tubing string having a tubing bore;
a housing having an upper end connected to said coiled tubing string and having an actuating chamber and a sampling chamber defined therein, said actuating chamber being communicated with said tubing bore;
an actuator piston disposed in said housing and communicated with said actuating chamber, said actuator piston being movable from a first position to a second position relative to said housing in response to an increase in fluid pressure communicated to said actuating chamber through said tubing bore of said coiled tubing string; and
a sampling valve assembly having an initial position wherein said sampling chamber is empty, an intermediate position wherein said sample chamber is free to fill with a well fluid sample, and a final position wherein said well fluid sample is trapped in said sample chamber, said sampling valve assembly being operably associated with said actuator piston so that in response to said actuator piston moving from its said first position to its said second position said sampling valve assembly is released from its said initial position.

18. The apparatus of claim 19, further comprising:

said housing having an exterior and having a fill passage defined in said housing communicating said exterior with said actuating chamber and thus with said tubing bore; and a one-way check valve connected to said fill passage, said check valve being positioned to allow flow of well fluid from around said housing exterior through said fill passage into said actuating chamber and thus into said tubing bore, and to prevent flow of fluid from said tubing bore out through said fill passage.

19. The apparatus of claim 18, further comprising:

said housing having a relief passage therein communicating said actuating chamber with said housing exterior; and a pressure responsive relief valve associated with said relief passage, said relief valve having a first position wherein said relief passage is closed and a second position wherein said relief passage is open, said relief valve being responsive to an increase in fluid pressure in said actuating chamber above a pressure at which said actuator piston is moved from its first position to its second position.

20. The apparatus of claim 18, wherein:

said housing has a relief port defined therein;

said actuator piston includes a first part and a second part and a releasable connector connecting said first and second parts;

said first part of said actuator piston is movable between first and second positions corresponding to said first and second positions of said actuator piston; and said releasable connector includes a means for releasing said second part from said first part after said first part reaches its said second position and for allowing said second part to continue moving relative to said first part to uncover said relief port so that said relief port is communicated with said actuating chamber.

21. The apparatus of claim 20, wherein:

said one-way check valve is carried by said second part of said actuator piston.

22. A pressure operated actuator for a sampling tool, comprising:

an actuator housing having proximal and distal ends, a central housing passage extending longitudinally from proximal end to said distal end, a housing exterior, a fill passage communicating said housing exterior with said central housing passage, and a relief port communicating said housing exterior with said central housing passage;

an actuator sleeve slidably received in said central housing passage, said actuator sleeve having an initial position wherein said relief port is blocked and said fill port is open, and a final position located distally from said initial position wherein said relief port is open, said actuator sleeve having a sleeve bore defined longitudinally therethrough; and a one-way check valve disposed in said sleeve bore at a position proximal from said relief port and carried by said actuator sleeve, said check valve being oriented to permit flow through said sleeve bore in a proximal direction and to prevent flow through said sleeve bore in a distal direction.

23. A tubing pressure actuated well sampling apparatus to be run on a tubing string, comprising:

a housing having an actuating chamber defined therein, and having an open proximal housing end including a connector adapted to connect said housing to said tubing string so that said actuating chamber communicates with a tubing bore of said tubing string;

said housing further including a low pressure zone and a sample chamber defined therein, and including a housing exterior and a sampling passage communicating said housing exterior with said sample chamber;

a sampling valve received in said housing and having a differential pressure power piston associated therewith, said power piston having first and second sides communicable with said housing exterior and said low pressure zone, respectively, said sampling valve being movable by said power piston to close said sampling passage and trap a well fluid sample in said sample chamber;

a hydraulic blocking valve disposed hydraulically between said power piston and one of said housing exterior and said low pressure zone, said hydraulic blocking valve having a closed position which hydraulically blocks said power piston from moving, and an open position which permits said power piston to be moved by a differential pressure between said housing exterior and said low pressure zone;

a pressure responsive actuating piston disposed in said actuating chamber and having a first side communicated with said open proximal end of said housing and a second side communicated with said housing exterior, said actuating piston being movable distally by a pressure differential from said first side toward said second side thereof when a pressure increase is applied to said tubing bore; and an actuator, operably associated with said power piston and said hydraulic blocking valve, said actuator being movable by said actuating piston to move said hydraulic blocking valve to its said open position.

24. The apparatus of claim 23, comprising:

a one-way check valve oriented to allow flow of well fluid into said actuating chamber and to block flow of fluid out of said actuating chamber.

25. The apparatus of claim 23, comprising:

a relief port defined in said housing communicating said actuating chamber with said housing exterior; and a relief valve movable by said actuating piston to uncover said relief port after said hydraulic blocking valve is moved to its said open position.

26. A sampling apparatus for trapping at least two separate well fluid samples, comprising:

a housing having first and second sample chambers defined therein, and having first and second sample ports communicating an exterior of said housing with said first and second sample chambers, respectively;

first and second sample valves disposed in said housing and associated with said first and second sample ports, respectively, each sample valve having an open position wherein its associated sample port is open to allow well fluid to flow into its associated sample chamber;

a displaceable member disposed in said first sample chamber and arranged and constructed so that as said first sample chamber fills with a well fluid sample said displaceable member is moved from a first position to a second position; and an actuator assembly operably associated with said second sample valve and with said displaceable member, said actuator assembly having an unactuated position wherein said second sample valve is closed and an actuated position wherein said second sample valve is allowed to move to its said open position, said displaceable member and said actuator assembly being so arranged and constructed that said displaceable member engages said actuator assembly and moves said actuator assembly to its said actuated position as said displaceable member moves from its said first position to its said second position.

27. A method of collecting a well fluid sample from a well, comprising:

(a) running a sampling tool into a well on a coiled tubing string;

(b) actuating said sampling tool by increasing fluid pressure in said coiled tubing string;

(c) trapping said well fluid sample from said well in said sampling tool in response to said increasing of fluid pressure in said coiled tubing string;

(d) retrieving said coiled tubing string and said sampling tool containing said well fluid sample from said well;

(e) after step (b), opening a relief port and communicating a tubing bore of said coiled tubing string with said well; and (f) during step (d), draining well fluid from said tubing bore through said relief port.

* * * * *